United States Patent [19]

Aidn et al.

[11] 4,053,858

[45] Oct. 11, 1977

[54] MAGNET SYSTEM FOR AN ELECTROMAGNETIC RELAY

[75] Inventors: Martin Aidn, Degerndorf; Eberhard Wanka, Dachau, both of Germany

[73] Assignee: Siemens Aktiengesellschaft, Berlin & Munich, Germany

[21] Appl. No.: 631,081

[22] Filed: Nov. 12, 1975

[30] Foreign Application Priority Data

Nov. 20, 1974 Germany ..... 2455018

[51] Int. Cl.[2] ..... H01F 7/14

[52] U.S. Cl. ..... 335/276; 335/128; 335/281

[58] Field of Search ..... 335/281, 276, 128

[56] References Cited

U.S. PATENT DOCUMENTS 3,023,286 2/1962 Bourne et al. ..... 335/276

FOREIGN PATENT DOCUMENTS 1,348,525 10/1962 France ..... 335/281

944,677 6/1965 Germany ..... 335/281

*Primary Examiner*—Harold Broome

*Attorney, Agent, or Firm*—Hill, Gross, Simpson, Van Santen, Steadman, Chiara & Simpson

[57] ABSTRACT

An electromagnetic relay has an angled yoke affixed to a first end of a magnetizable coil core and extending parallel to said core to an end spaced radially adjacant an opposite end of the core. An armature is pivotally supported upon the free end of the yoke for movement toward and away from said opposite end of the core. The yoke is formed with a recess or slot in its free end which engages a lateral projection from a flange affixed about said opposite end of the core. The projection cooperates with the yoke recess to fix the free end of the yoke in lateral and radial position with respect to the core. The projection and recess align the yoke in position parallel to the core during assembly of the relay, assuring good magnetic contact beween the core and the yoke at the point of attachment. The recess and projection also reinforce the assembly against mechanical displacement of the yoke during service with consequent breaking or impairment of the magnetic circuit connection.

5 Claims, 3 Drawing Figures

MAGNET SYSTEM FOR AN ELECTROMAGNETIC RELAY

BACKGROUND OF THE INVENTION

1. Field of the Invention

The invention relates to a magnet system for an electromagnetic relay.

2. The Prior Art

Magnetic relays having a core arranged in a coil body and an angular yoke whose first flank is connected to the core and whose second flank extends in parallel to the axis of the core have long been known and are used in numerous relay constructions. The end edge of the yoke flank generally serves as bearing edge for the armature which forms the operative air gap with the free core pole. A disadvantage of known constructions of this kind however, is that the relatively long free flank of the angular yoke and the coil are secured to one another merely at the end of the coil core. For production reasons, such securement is generally merely a press fit which easily loosens under lateral strain. Strain of this type can occur during production, during assembly, and during operation. In addition, during production a danger exists that the coil core will be pressed obliquely into the corresponding opening of the yoke.

An oblique impression or the subsequent loosening of the coil core not only impairs the mechanical stability of the magnet system, but in fact undesirable deformations of this type also impair the magnetic circuit. Thus not only is the magnetic junction between the core and yoke damaged, but the operative air gap is altered when the magnet core and the yoke flank serving as armature bearing do not assume the given positions in relation to one another. The outcome is a drastic fluctation in energization values, which reduces the quality of the relay.

SUMMARY OF THE INVENTION

The object of the invention is to prevent both an oblique impression of the coil core and a subsequent loosening of the connection between core and yoke. In accordance with the invention, the free end of the second flank of the yoke is formed with a recess which receives a projection formed in the coil body.

The joint between the coil body and the second flank of the yoke provides the magnet system with a good mechanical stability and with a uniformly good magnetic circuit. The projection of the coil body intercepts lateral forces which act upon the yoke and the coil body. The joint between the coil core and the yoke is thus substantially relieved of pressure, so loosening of the core is avoided. The arrangement of the coil body projection in the direct vicinity of the armature bearing ensures that, even under the influence of external forces, the armature bearing edge and the core pole surface remain in determinate positions in relation to one another. Consequently the magnetic junctions also remain constant.

In an advantageous embodiment of the invention, the recess in the yoke flank is open to the free end of the flank, to serve as a guide slot during joining to the coil core. The entire coil, together with the core, can thus be connected properly to the yoke in one operation. In a further embodiment of the invention, the coil body projection is also provided with deformable lateral extensions, to ensure a firm seat of the coil body projection in the yoke recess. Consequently both a formfit safeguard against lateral displacement and also a force-fit in the longitudinal direction of the coil body projection are provided. The lateral extensions on the coil body projection can also, however, be of such formation that they extend over the yoke flank recess and thus produce a form-fit in two directions. The insertion of the coil body projection into the recess of the yoke flank is simplified by sloping abutments.

DESCRIPTION OF THE PREFERRED EMBODIMENTS

Figure 1:
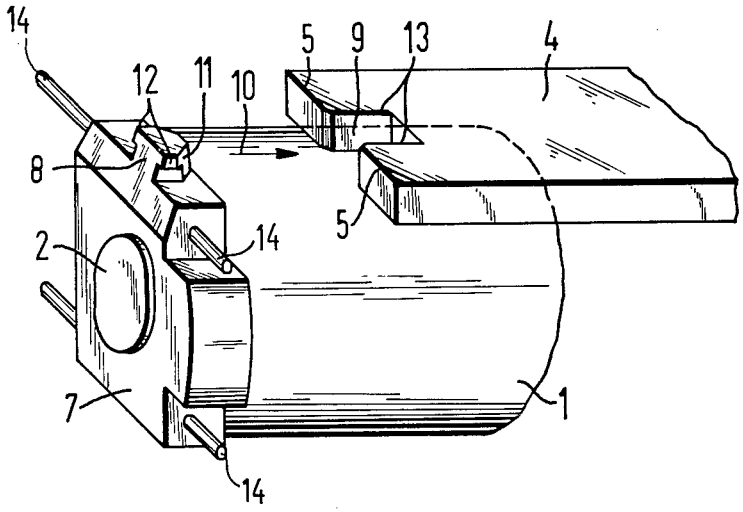
FIG. 1 is a perspective view showing the connection between a coil body flange and a yoke flank.
Figure 2:
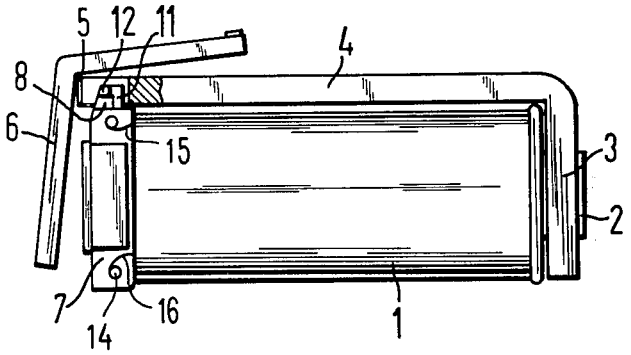
FIG. 2 shows in a side view, partially in section, a magnet system assembled in accordance with the invention.

The magnet system in FIGS. 1 and 2 comprises a coil 1 having a core 2 secured by force fit to a first flank 3 of an angular yoke. A second flank 4 of the angular yoke runs parallel to the core 2 and as its free end forms a bearing edge 5 for an angular armature 6.

In accordance with the invention, a coil flange 7 on the coil body 1 and facing the armature has a projection 8 which engages into a recess 9 formed in the yoke flank 4. Thus the coil or body and yoke are centered during assembly together in the direction of the arrow 10 and the securement of the coil core 2 and the first flank 3 of the yoke are relieved of supportive pressure. The projection 8 is pressed into the recess 9 so as not to project beyond the bearing edge 5.

The projection 8 which consists of synthetic material has sloping abutments 11 which facilitate centering during the press assembly process. In addition it is provided with lateral extensions 12 which, during the impression process, become deformed between sides walls 13 of the recess 9 of the yoke flank 4 and thus ensure a firm seat of the coil body projection 8 in the recess 9. Thus the coil body flange 7 gives both vertical and lateral support to the yoke flank 4. Pin like projections 14 formed on the sides of the flange 7 in an injection molding or similar process are conveniently employed as connecting or snubbing pegs for ends 15, 16 of wires of the coil 1, as in FIG. 2.

Figure 3:
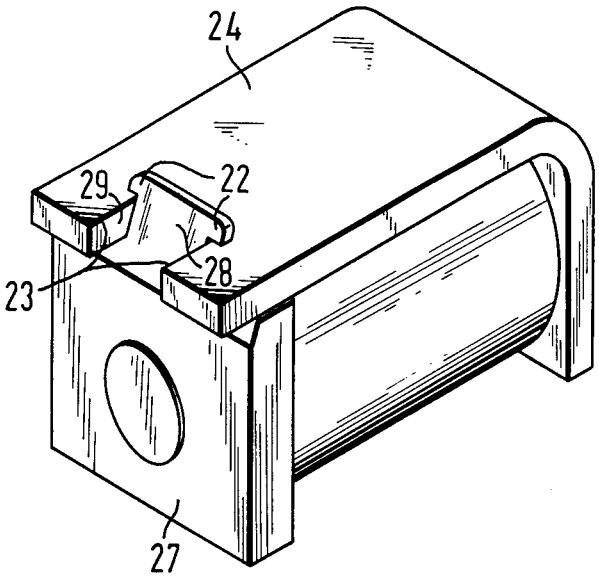
FIG. 3 is a perspective view of a second embodiment of the invention.

A second embodiment of the invention is shown in FIG. 3. A form-fit connection between a coil flange 27 and a yoke flank 24 is also provided at right angles to the coil axis. Lateral extensions 22 of a guide projection 28 extend beyond the side walls 23 of the recess 29 and establish the desired form-fit.

Although various minor modifications might be suggested by those versed in the art, it should be understood that we wish to embody within the scope of the patent warranted hereon all such modifications as reasonably and properly come within the scope of our contribution to the art.

We claim as our invention:

1. An electromagnetic relay having a coil body with an elongated magnetizable core extending axially therethrough from a rear end press-fittingly engaging a first end of an angled, magnetizable yoke to a front end adjacent a pivotable armature, said yoke having a second end extending to a point spaced adjacent said front end of said core and receiving said armature pivotally thereon, and said coil body having a non-magnetizable coil flange affixed about said coil axially adjacent said front end of said core, and wherein:

said coil flange has a projection formed thereon extending laterally of said coil body into a position engageable with said second end of said yoke; and said second end of said yoke forms an aperture sized for press-fittingly receiving said projection therein upon assembly of said yoke to said core and coil body.

2. An electromagnetic relay as defined in claim 1, wherein said aperture in said second end of said yoke extends axially of said yoke to form a slot.

3. An electromagnetic relay as defined in claim 1, wherein said projection has lateral extensions which are deformable upon engagement with side walls of said aperture upon assembly.

4. An electromagnetic relay as defined in claim 1, wherein said projection extends outwardly of said yoke and has at least one lateral extension thereon engageable with an outer face of the yoke, thereby to reinforce capture of the yoke by said projection.

5. An electromagnetic relay as defined in claim 1, wherein said projection has a pair of opposite abutment walls sloping together inwardly in the rearward axial direction, thereof to facilitate alignment and centering of said yoke and the aperture thereof during assembly.

* * * * *